US009220337B1

(12) United States Patent
Wenzel

(10) Patent No.: US 9,220,337 B1
(45) Date of Patent: Dec. 29, 2015

(54) PORTABLE BEVERAGE TABLE

(71) Applicant: Mark Wenzel, Garden City, NY (US)

(72) Inventor: Mark Wenzel, Garden City, NY (US)

( * ) Notice: Subject to any disclaimer, the term of this patent is extended or adjusted under 35 U.S.C. 154(b) by 0 days.

(21) Appl. No.: 14/725,761

(22) Filed: May 29, 2015

Related U.S. Application Data

(60) Provisional application No. 62/028,297, filed on Jul. 23, 2014, provisional application No. 62/097,395, filed on Dec. 29, 2014.

(51) Int. Cl.

| | |
|---|---|
| ***A47B 85/00*** | (2006.01) |
| ***A47B 13/16*** | (2006.01) |
| ***A47B 3/12*** | (2006.01) |
| ***A47B 13/00*** | (2006.01) |
| ***A47B 37/04*** | (2006.01) |

(52) U.S. Cl.
CPC . *A47B 13/16* (2013.01); *A47B 3/12* (2013.01); *A47B 13/003* (2013.01); *A47B 37/04* (2013.01)

(58) Field of Classification Search
CPC ..... A47B 13/023; A47B 3/066; A47B 3/10; A47B 37/04; A47B 13/01; A47B 13/14; A47B 3/06
USPC ..... 108/25, 26, 150, 50.11, 38; 297/4
See application file for complete search history.

(56) References Cited

U.S. PATENT DOCUMENTS

| | | | | | |
|---|---|---|---|---|---|
| 162,304 | A * | 4/1875 | Postawka | A47B 13/023 | 108/150 |
| 2,568,534 | A * | 9/1951 | Baker | A47B 3/12 | 108/150 |
| 5,417,166 | A * | 5/1995 | Credle, Sr. | A47B 37/04 | 100/150 |
| 5,647,075 | A * | 7/1997 | Perkins | A45F 3/22 | 108/26 |
| 5,651,523 | A * | 7/1997 | Bridges | B60N 3/107 | 206/549 |
| 5,762,004 | A * | 6/1998 | Vashon | A47B 37/04 | 108/128 |
| 5,860,534 | A * | 1/1999 | Minneman | A47B 81/005 | 108/150 |
| 5,918,550 | A * | 7/1999 | Weir | A47B 5/06 | 108/152 |
| 6,059,138 | A | 5/2000 | Labruyere | | |
| 6,126,256 | A | 10/2000 | Does, II | | |
| 6,264,026 | B1 | 7/2001 | Bradley | | |
| 6,467,843 | B1 * | 10/2002 | Rossborough | A47C 3/34 | 108/150 |
| 6,487,977 | B1 * | 12/2002 | Williams | A45B 23/00 | 108/150 |
| 7,207,450 | B1 | 4/2007 | Franklin et al. | | |
| 7,641,156 | B2 | 1/2010 | Medders et al. | | |
| 7,766,179 | B2 | 8/2010 | George et al. | | |
| 2002/0117092 | A1 * | 8/2002 | Zeiders | A47B 23/041 | 108/43 |
| 2003/0188673 | A1 * | 10/2003 | Block | A47B 37/04 | 108/150 |
| 2007/0246091 | A1 * | 10/2007 | Becker | A45B 3/00 | 135/16 |
| 2010/0089294 | A1 * | 4/2010 | Medina | A47B 3/0913 | 108/25 |
| 2010/0163086 | A1 * | 7/2010 | Chavez | A45B 3/00 | 135/16 |
| 2010/0209662 | A1 | 8/2010 | Slade et al. | | |
| 2011/0209645 | A1 | 9/2011 | Albornoz Pinzon et al. | | |
| 2014/0102337 | A1 * | 4/2014 | Ralph | A47B 37/04 | 108/25 |
| 2015/0173505 | A1 * | 6/2015 | Mirth | A47B 13/16 | 211/186 |
| 2015/0208634 | A1 * | 7/2015 | Box | A01K 97/10 | 108/25 |

* cited by examiner

*Primary Examiner* — Jose V Chen
(74) *Attorney, Agent, or Firm* — Winston & Strawn LLP

(57) ABSTRACT

A portable table suitable for securely holding a variety of beverages and other items that can be used on a wide range of surfaces including sand and soft ground. The table can be easily transported with an integral handhold and a detachable leg or legs, which can be readily fastened to the bottom of the table when not in use. The portable table includes openings which securely hold the full range of beverages including traditional cans and bottles, as well as wine glasses and other containers with varying shapes.

14 Claims, 9 Drawing Sheets

PORTABLE BEVERAGE TABLE

This application claims the benefit of each of provisional applications 62/028,297 filed Jul. 23, 2014 and 62/097,395 filed Dec. 29, 2014, the entire content of each of which being expressly incorporated herein by reference thereto.

BACKGROUND

This invention relates to portable tables and more particularly to portable tables used to support a variety of beverages and accessories.

Portable tables to support beverages and accessories have a variety of primarily recreational uses. Such table can be used at the beach, at picnics, or even in the backyard to provide an easily relocatable and ready surface for beverages and other accessories. U.S. Pat. No. 6,264,026 to Bradley describes a food, beverage, and utility tray which includes an area for a plate and at least one cup holder with the tray designed to set directly on the ground with at least two supports. Although the cup holder can allow a wine glass stem to pass therein, it is not designed to provide support for the wine holding portion of the wine glass due to insufficient length of the legs that support the tray and the table requires a level surface to support the tray.

In order to accommodate wine glasses and provide support for beverages on non-level surfaces, U.S. Pat. No. 7,207,450 to Franklin et al. describes a beverage holding device with multiple arms with ring-shaped cupholders that have attached thereto open loops for supporting wine glasses on each cupholder. The device includes a support with a tapered or spiked end such that the holding device can be inserted into any malleable surface even if the surface is not level. The arms of the Franklin et al. device are collapsible such that it does not provide an upper surface to accommodate other items such as a wine bottle, plates or the like.

U.S. Pat. No. 7,641,156 to Medders et al. provides some additional surface area for a portable drink stand. Medders et al. describes a portable telescoping stand with a variety of attachments for holding beverages, wine glasses, wine bottles, flower vases, and other accessories. The drink stand support is also adjustable to account for varying surfaces. The upper plate like surface includes keyhole shaped openings for supporting wine glasses but other glass or bottle support structures are separately provided by a myriad of attachments which require connection to the stand when needed.

U.S. Patent Application Publication No. 2011/0209645 to Pinzon et al. provides a single unit that includes support for food, beverages and other accessories in a single unit. A wine glass holder is provided as an optional external attachment, but when present provides a somewhat bulky configuration. Also, the unit requires a flat surface or some type of holder (such as a fishing pole holder) for support.

In view of the foregoing, it is clear that there is a need for improved portable tables, a number of which are now provided by the present invention.

SUMMARY OF THE INVENTION

The present invention combines the various advantages of the prior art with a more versatile beverage holder that can securely support a full range of beverages including cans, bottles, and wine glasses as well as provide additional table space for other items. The beverage holders are minimized on the table surface so that space is provided for other accessories. The present invention is capable of support on any malleable surface even if not level. In addition, the present invention is configured for compact transport and also offers a detachable support which can be stored by connection to the lower surface of the table before use.

Accordingly, a portable table is now provided that comprises a plate having a periphery, a top surface, a bottom surface, a sidewall, and a thickness, at least two beverage supports provided in the plate, a lateral channel extending through the thickness of the plate the opening to the plate periphery and at least one leg for supporting and positioning the plate upright so that the plate top surface is available as a top surface of the table.

Advantageously, each support includes a semicircular shelf that partially surrounds a circular opening that passes through the plate from the top surface to the bottom surface, with the opening in the plate being larger above the shelf, wherein the shelf is configured to support and hold a beverage glass or beverage container that is placed in the opening. Preferably, the shelf has a thickness that is equal to 1/10 to 1/2 of the thickness of the plate but more preferably is between 1/4 to 2/5 the thickness of the plate. Also, the channel is configured to allow a wine glass stem to pass from the plate periphery to the opening for placement of the wine glass on the support with the stem freely extending below the bottom surface of the table. Preferably, the beverage supports are arranged in the plate to facilitate balancing of the table when containers or glasses are placed in the support.

The leg may be removably associated with the plate, and if so, the table further comprises at least one fastening device associated with the bottom surface of the plate for receiving and attaching the leg to the table through an attachment point. The attachment point may conveniently include threads and the leg has a body with a threaded end that attaches to the attachment point by engaging the threads of the attachment point. And when the leg is not attached to the fastening device, the plate can include clip members on the lower surface of the plate for securing the leg to the table for compact transport. Preferably, the leg has a lower end that has a smaller diameter than the body of the leg to facilitate insertion of the leg into sand or soft ground.

The table may include an opening that serves as a handhold for grasping and transport of the table. And when not in use, the table may include at least one or preferably two loops located on the periphery of the table. These loops are configured for holding accessories such as for hanging sunglasses or holding a cheese knife when snacking at the beach as well as for clipping on key chains that have small carabineers.

The table is typically constructed of wood, metal, plastic or a composite material, with the upper surface and periphery of the plate being smooth to the touch and optionally including a chamfer between the plate upper surface and periphery.

BRIEF DESCRIPTION OF THE DRAWINGS

Preferred features of the invention are now described in connection with the appended drawings figures, wherein.

DETAILED DESCRIPTION OF THE INVENTION

The invention and its various embodiments can now be better understood by turning to the following detailed description of the preferred embodiments, which are presented as illustrated examples of the invention defined in the claims.

The plate of the invention is suitable for securely holding a wide variety of beverages and other items. The portable table includes a handhold for transporting the portable table, attached loops to various accessories such as sunglasses, utensils, towels and the like when the table is in use, and at least two beverage supports designed to securely hold a wide range of beverages including bottles, cans, typical drinking glasses, and wine glasses. The portable nature of the table is enhanced by the use of a detachable leg or legs which provides support for the table on almost any surface including sand and soft ground. The bottom surface of the portable table includes a fastening device or devices which hold the detachable leg or legs during transport and when not in use to support the portable table.

The beverage supports in the portable table provide the ability to securely hold both standard cans or bottles as well as containers with varying diameters such as wine glasses. The beverage supports have a semicircular opening with a lateral passage to the periphery of the portable table such that varying diameter beverage containers or glasses can be placed in the beverage support. The semicircular opening of the beverage support has a semicircular shelf that is adjacent to the interior or sidewall of the semicircular opening. A traditional bottle or can rests on the semicircular shelf which is below the top surface of the portable table such that the sidewall securely holds the can or bottle. A varying diameter beverage glass or container can be placed in the beverage support such that the large diameter portion (such as the bowl of a wine glass) is held by the semicircular shelf and the smaller diameter portions (such as a wine glass stem) are below the beverage support and the bottom surface of the table. Typically, the shelf and bottom chamfer are 0.25" inch thick which is ⅓ of the 0.75" thick plate that is used.

Portable table 1 can be made of wood, metal (such as aluminum), plastic, a composite material, or any material with sufficient structural strength to serve as a table and a support for beverage glasses or containers.

Figure 1:
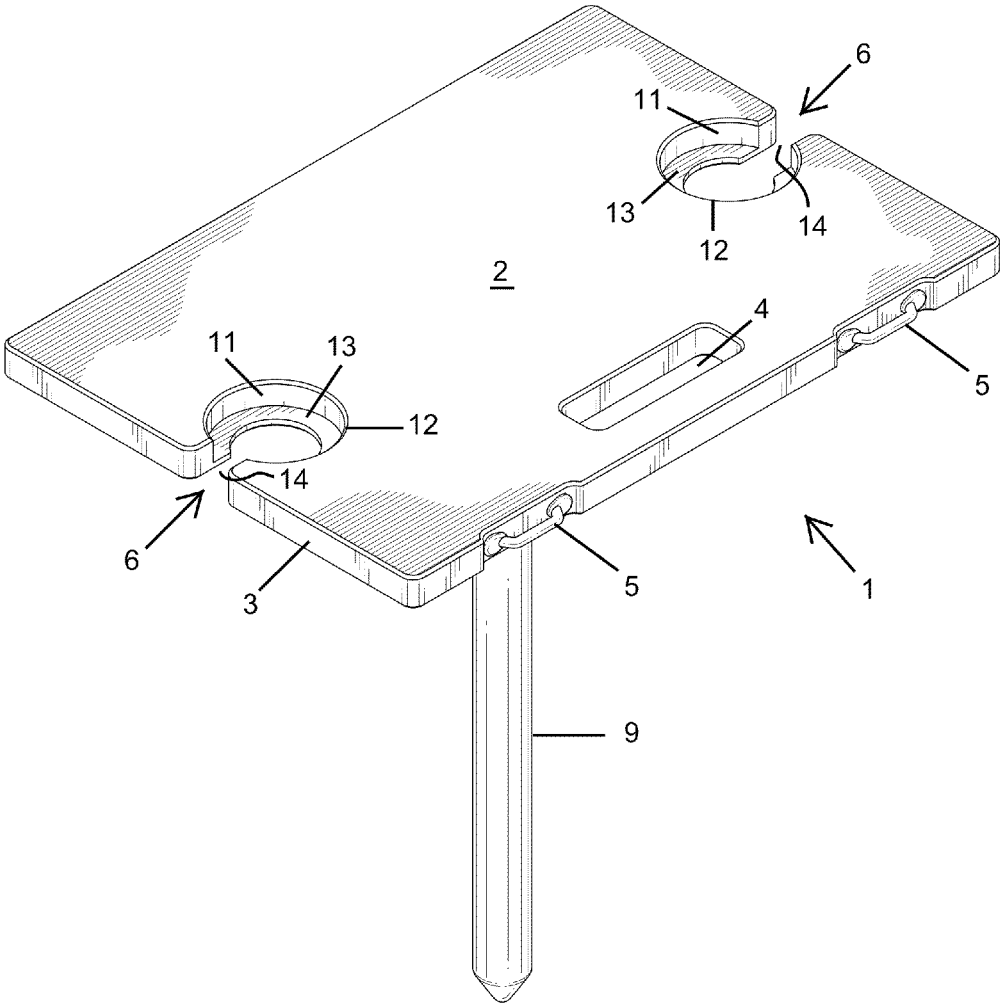
FIG. 1 is a perspective view of a portable table according to the invention.

FIG. 1 depicts the portable table 1 with a top surface 2. Top surface 2 is adjacent and perpendicular to the periphery 3 of portable table 1. Periphery 3 typically has a smooth finish that is provided in different ways depending upon the type of material that is used. If the table is made of wood, the top surface and periphery can be polished and varnished, if made of metal, a polishing step is included, and if made of plastic, moldings or extrusions are sufficiently smooth to the touch of the user. Of course, a smooth finish is not required for the proper functioning of portable table 1.

Figure 7:
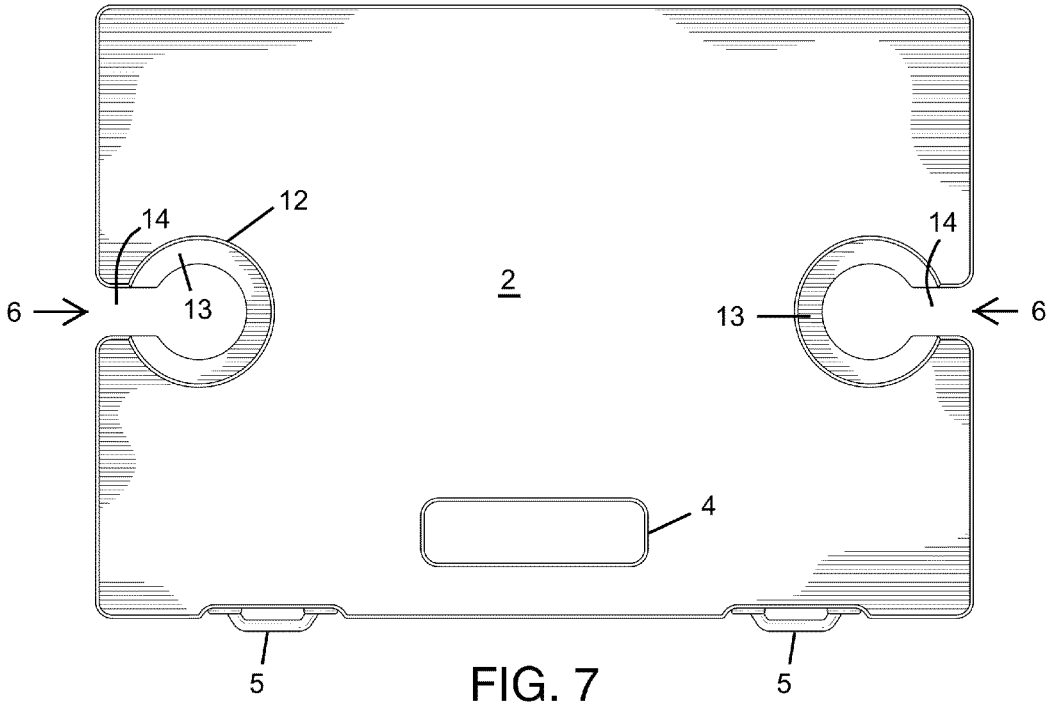
FIG. 7 is a top view of the portable table of FIG. 1.

FIGS. 1 and 7 depict the top view of at least one opening 4, in top surface 2, which serves as a handhold for transporting the table. Opening 4 can be any shape or size that is suitable for grasping with a hand. Two loops 5 are also shown as attached to the table periphery 3. Loops 5 are 1" across on the inside and only protrude approximately 0.5" on the inside. These loops are designed for any purpose including holding accessories such as towels or utensils during use. Loops 5 can be any shape and are secured to the table for holding, for example, towels or utensils, and can be made of metal, plastic, or any material with sufficient structural strength to hold relatively light items.

The top view of the beverage supports 6 are also shown in FIG. 1 but these are further discussed herein in the description of FIG. 7. The top surface 2 is sufficiently flat to provide a table surface for additional items such as food or wine bottles.

Figure 2:
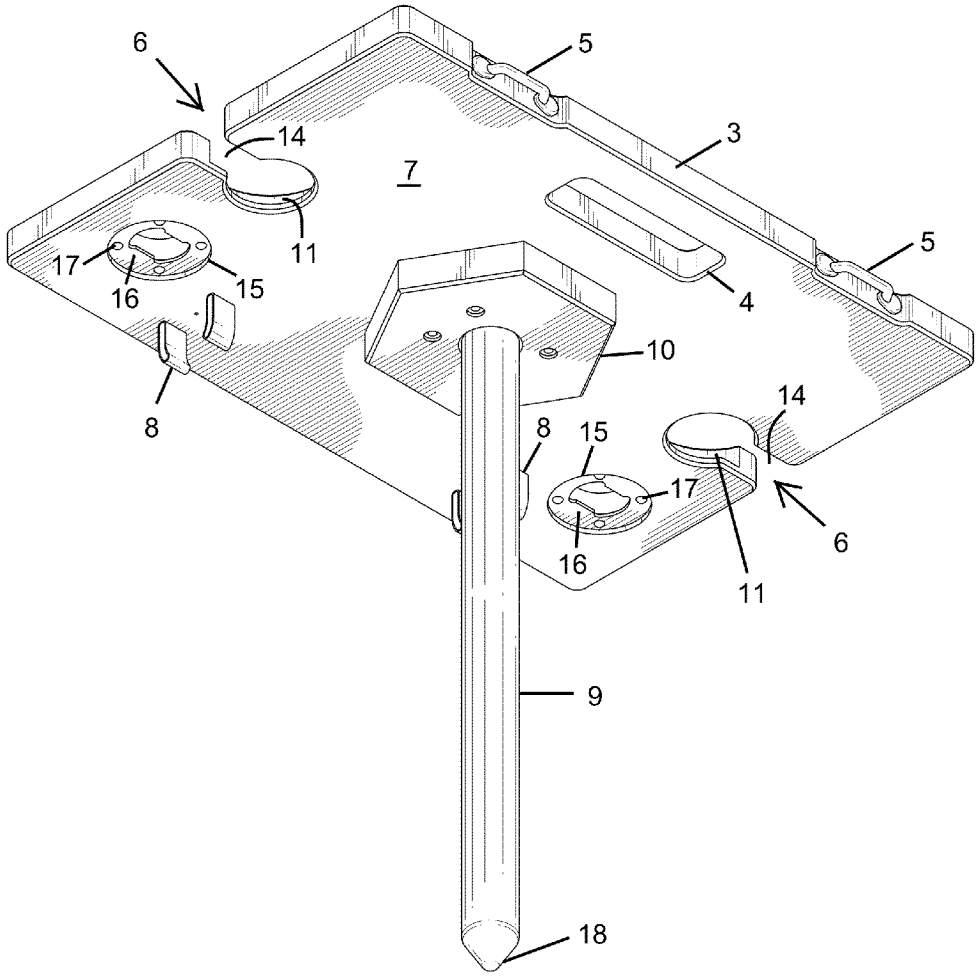
FIG. 2 is a perspective view of the bottom surface of the portable table of FIG. 1.
Figure 3:
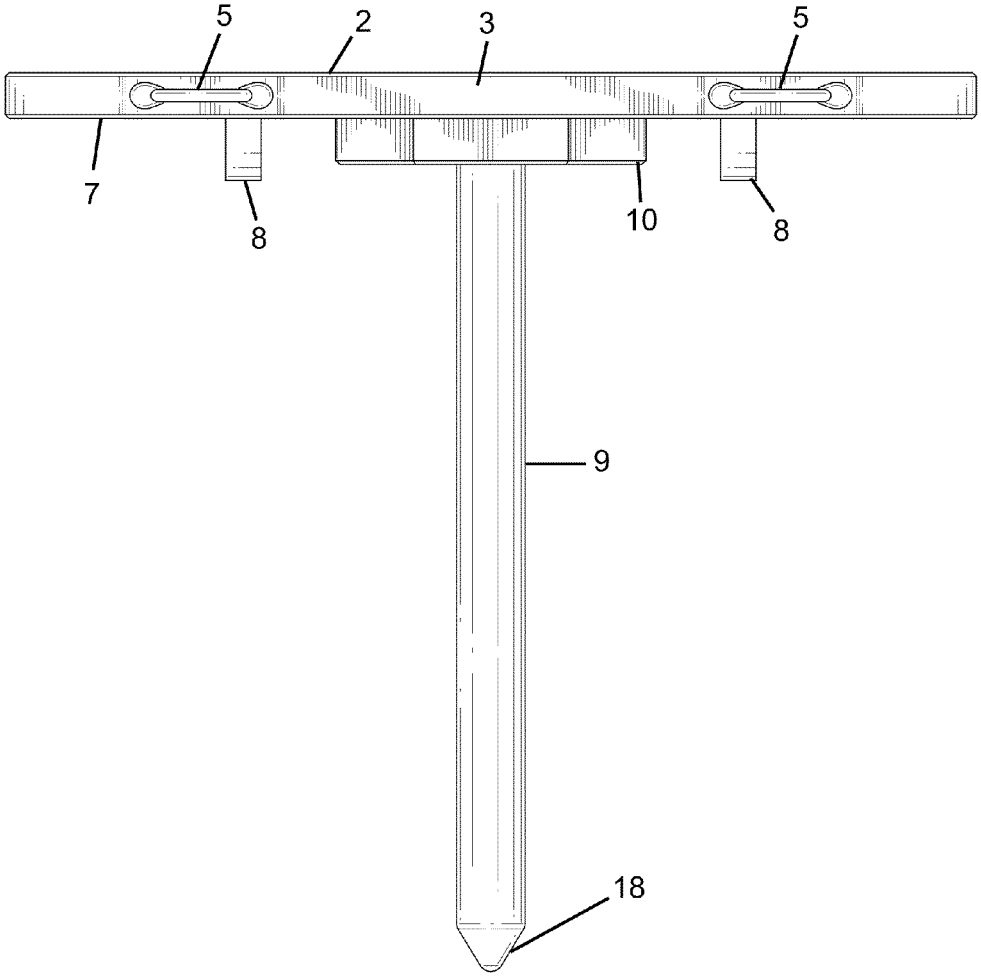
FIG. 3 is a front view of the portable table of FIG. 1.
Figure 4:
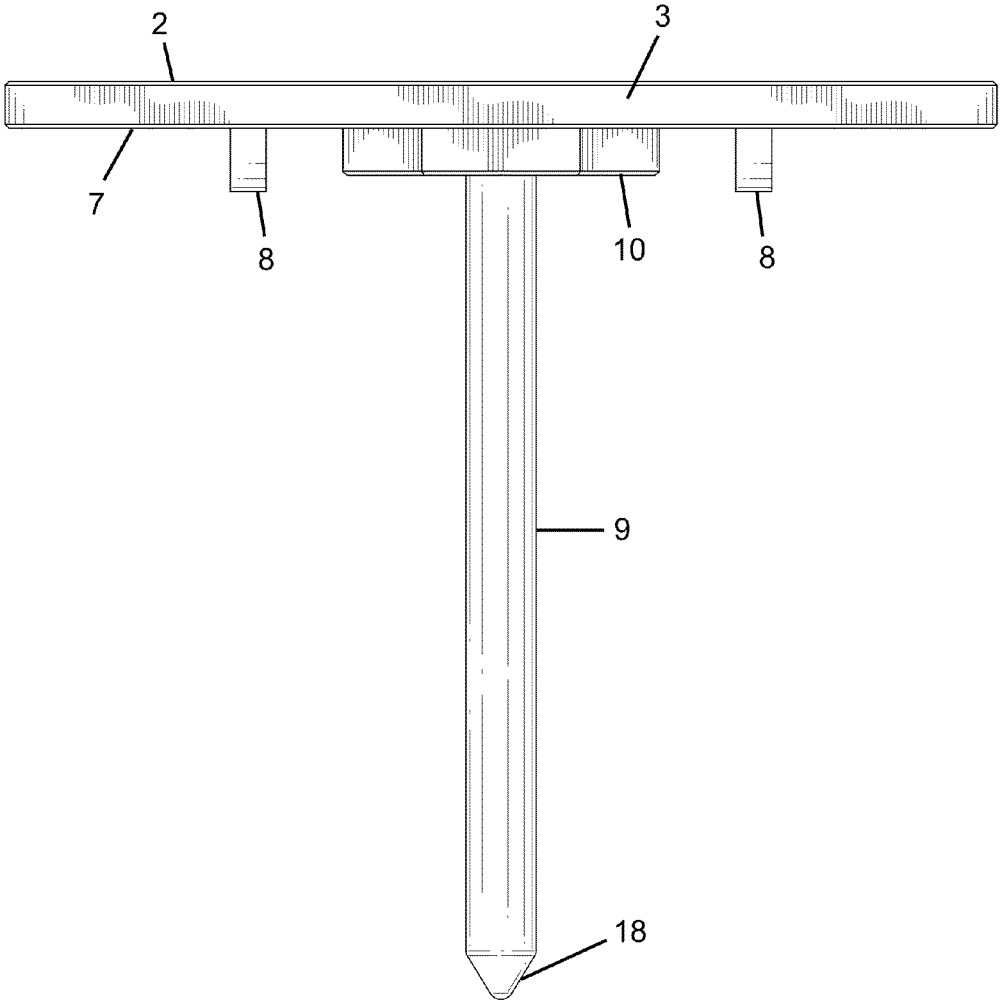
FIG. 4 is a back view of the portable table of FIG. 1.
Figure 5:
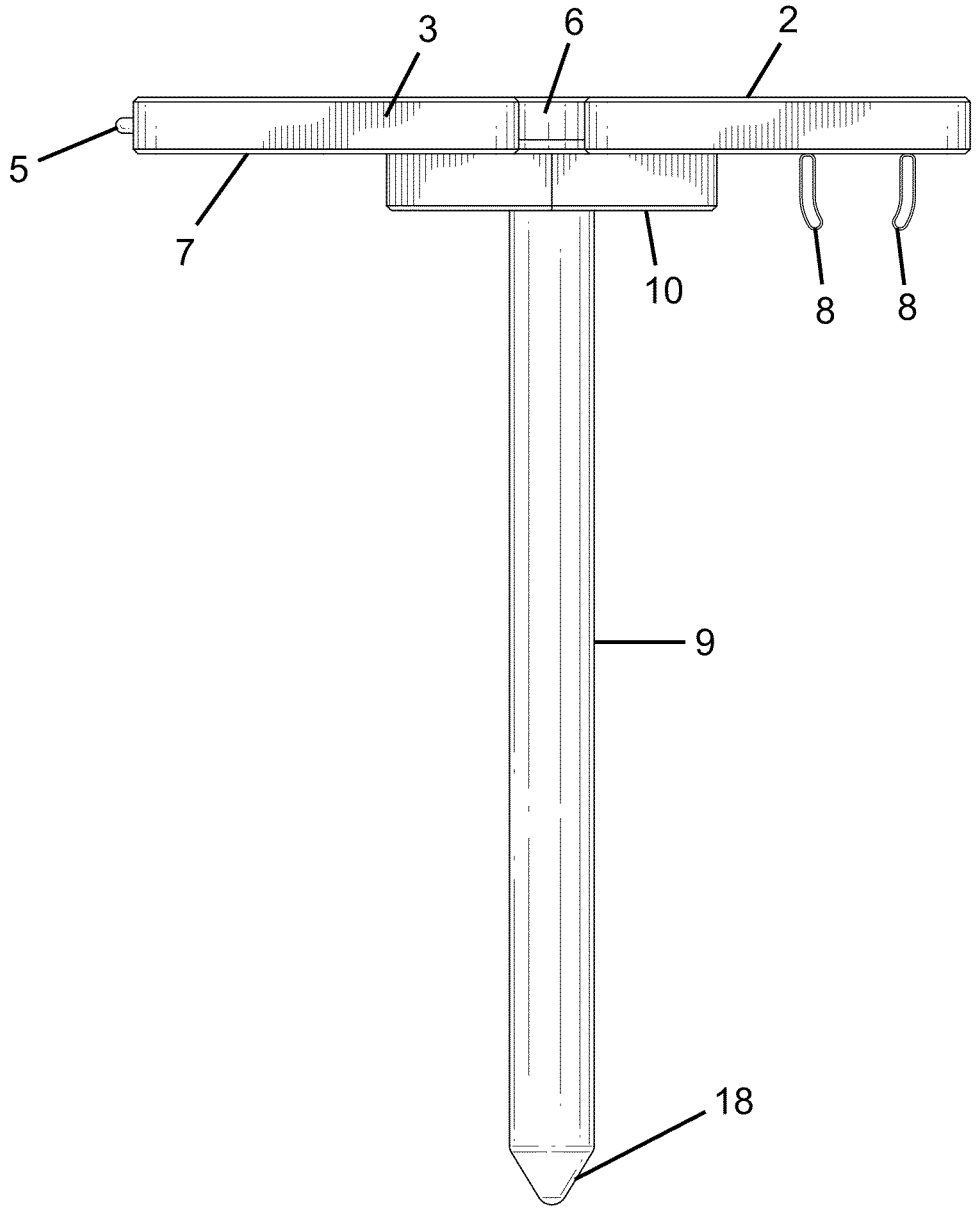
FIG. 5 is one end view of the portable table of FIG. 1.
Figure 6:
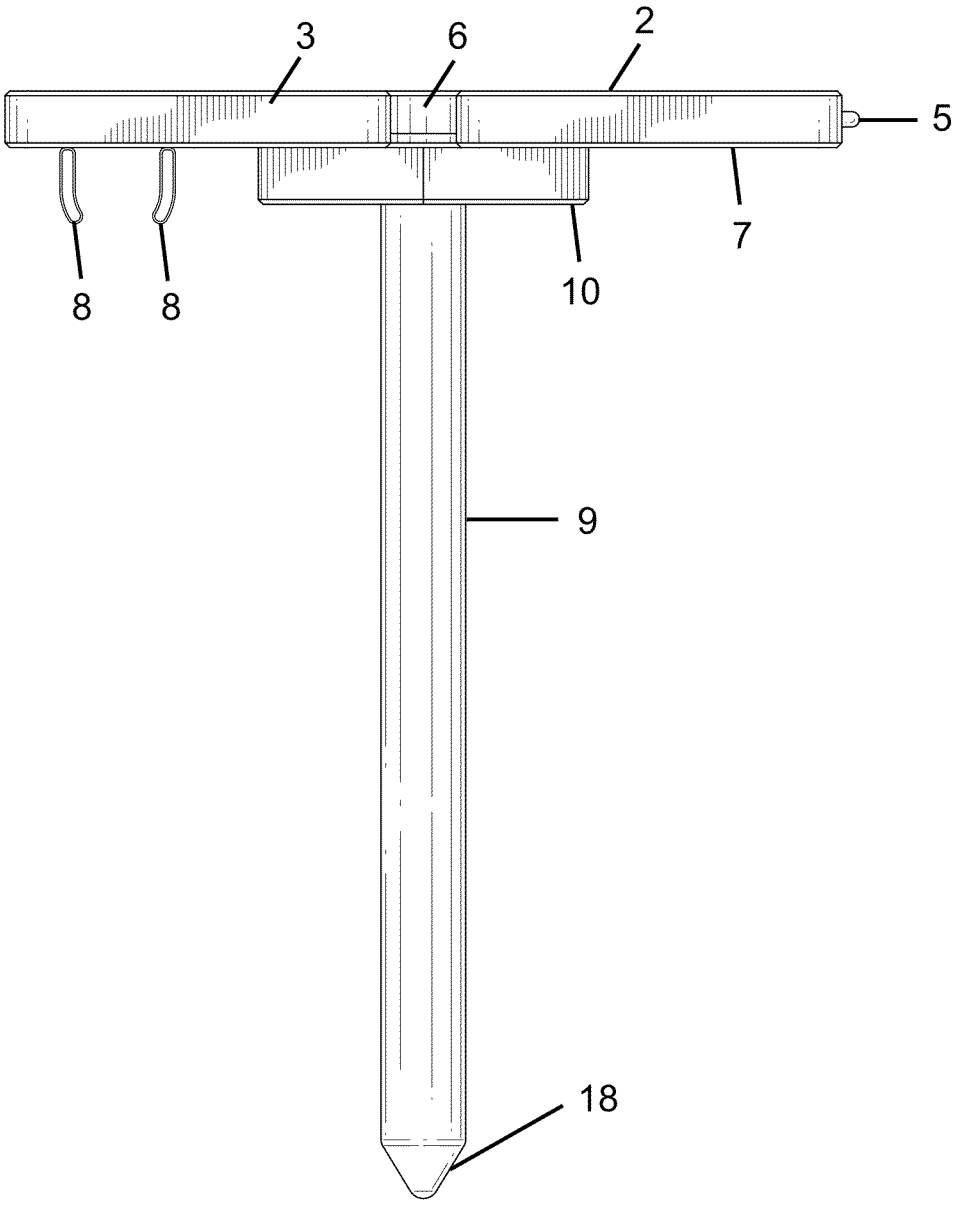
FIG. 6 is an opposite end view of the portable table of FIG. 1.
Figure 8:
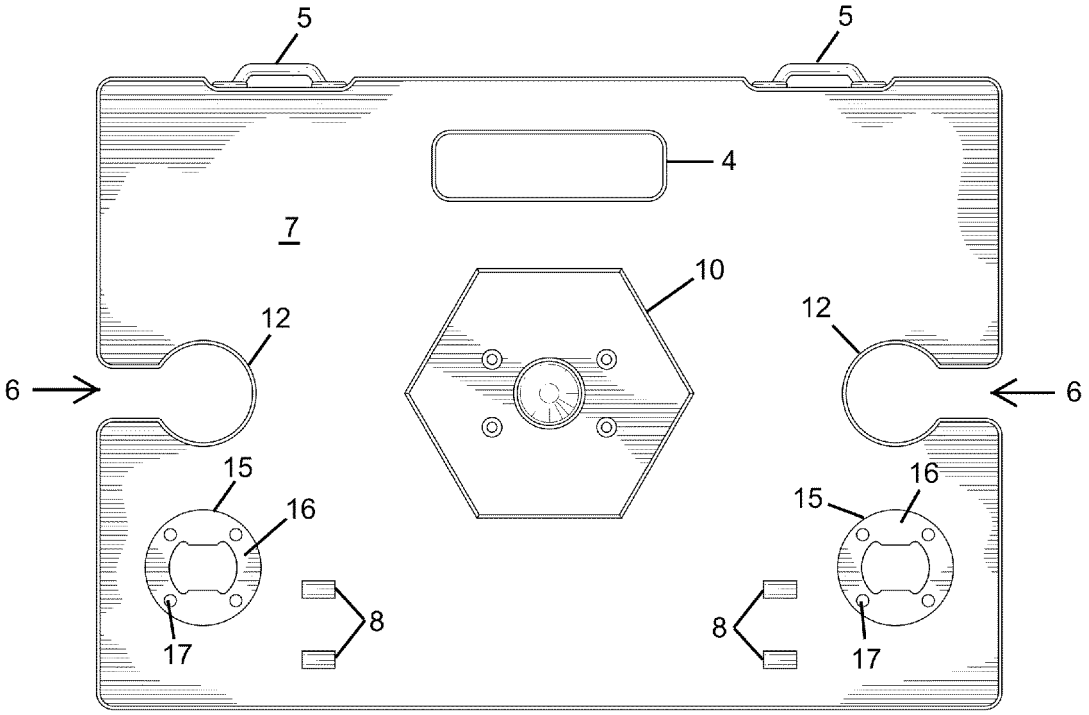
FIG. 8 is a bottom view of the portable table of FIG. 1.
Figure 9:
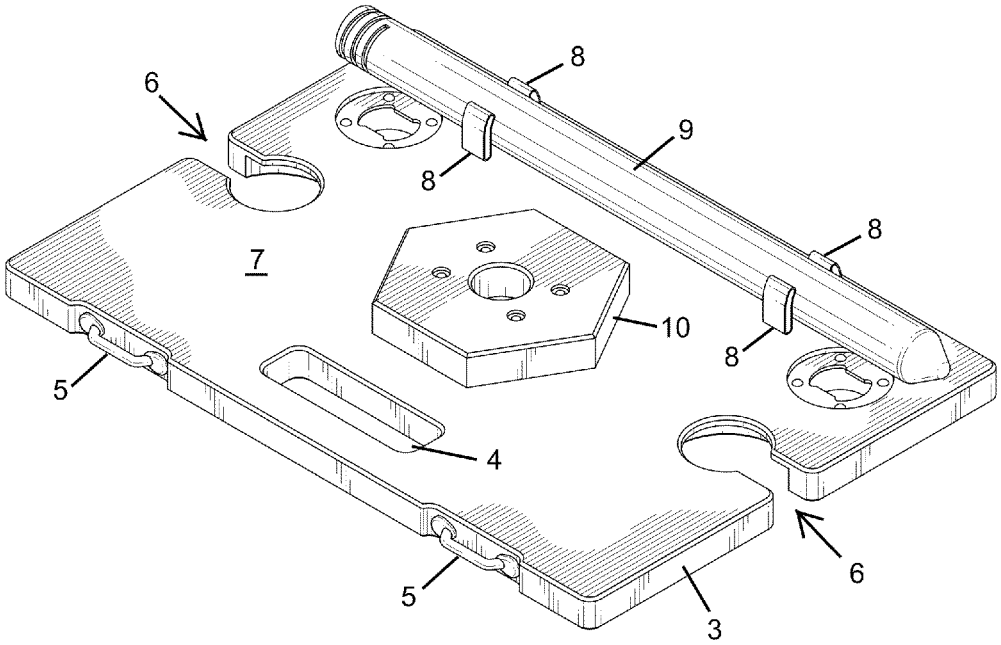
FIG. 9 is a bottom perspective view of the portable table of the invention in a collapsed configuration for transport.

FIGS. 2 and 8 depict the bottom surface 7 of the portable table 1, and a bottom view of opening 4, loops 5, and beverage supports 6. Attachment point 8 in conjunction with at least one detachable leg 9 provides the mechanism for supporting portable table 1 off the ground. Attachment point 8 can be, for example, a threaded opening to receive the threaded end or ends of the detachable leg(s) 9. Alternatively, attachment point 8 can have a snap fitting or slot to receive the fitted end or ends of the detachable leg(s), or attachment point 8 can be any other connection that serves to readily attach and remove detachable leg 9. For detachable leg 9, the end of the leg or legs not connected to attachment point 8 can taper to an end 18 having a diameter substantially smaller than the body of detachable leg 9 to facilitate inserting the leg into sand or soft ground to provide support for portable table 1.

Alternatively, multiple detachable legs 9 can be used with the ends of the legs not connected to attachment point 8 either having tapered points as described above or with more conventional flat ends to support portable table 1 off the ground. Other alternatives include a single detachable leg with multiple smaller legs, connected at or near the end of detachable leg 9, that can be extended to form, e.g., a tripod to support portable table 1 off the ground.

The bottom surface includes two indentations 15, each of which includes a bottle opener 16 therein. The indentations 15 are bored holes that include a deeper central opening and a shallower peripheral opening that terminates in a shelf. Upon which the bottle opener 16 can be attached with nails 17 or by an adhesive. These arrangements allow the users on each side of the table to access the indentations and bottle openers to remove caps from beer or soda bottles.

The bottom surface 7 also includes at least one fastening device 10 which serves to hold at least one detachable leg 9 when detachable leg 9 is not connected to attachment point 8. Portable table 1 can have multiple fastening device(s) 10 with one for each leg. Fastening device 10 can be one or more elastic metallic open-ended clips which retain detachable leg 9 by friction, or the clips can include a retaining screw to hold detachable leg 9 in the clip. Alternatively, fastening device 10 can be any structure which can securely hold detachable leg 9 and which facilitates readily attaching and removing detachable leg 9 from fastening device 10. Fastening device 10 can be made of metal, plastic, or any material with sufficient structural strength to hold detachable leg 9.

FIGS. 3 to 6 are side and end views of the portable table of the invention in an operative position. The end 18 of leg 9 would be pushed into a supporting surface, such as sand or the ground to place the table in position for use. As further disclosed herein, the top surface 2 can support a wine bottle or other items while cups, glasses or other appropriately sized beverage containers can be placed in supports 6.

FIGS. 1 and 7 depict details of the beverage support 6. Beverage support 6 is an opening that extends from the top surface 2 through bottom surface 7. Each beverage support 6 typically serves to hold one beverage glass or beverage container. A beverage glass is normally an open container such as a traditional drinking glass or a wine glass. A beverage container is normally a can or bottle, such as a standard soda can or beer bottle. A sidewall 11, a semicircular opening 12, a semicircular shelf 13, and a lateral passage 14 comprise beverage support 6. Sidewall 11 is the interior of semicircular opening 12 and lateral channel 14 and extends from top surface 2 to bottom surface 7. The circular perimeter of semicircular opening 12 is only broken by lateral channel 14. Semicircular opening 12 is sized to be larger than the largest diameter of a typical beverage glass or beverage container. Semicircular shelf 13 is located adjacent to sidewall 11 and inside of semicircular opening 12 and extends around the entire inner perimeter of semicircular opening 12 with the exception of lateral channel 14. Semicircular shelf 13 is flush with bottom surface 7 and typically no more than one-half of the thickness of sidewall 11. Semicircular shelf 13 is flush with bottom surface 7 and has a thickness sufficient to support the container or glass that is to be supported when placed upon it. Typically no more than one-third of the thickness of sidewall 11 is necessary for this function.

Semicircular shelf 13 is sized to reduce the diameter of semicircular opening 12 to less than the largest diameter of a typical beverage glass or beverage container. Semicircular shelf 13 allows beverage support 6 to securely hold a beverage glass or beverage container as the bottom of the beverage glass or beverage container rests on semicircular shelf 13 and is supported laterally by sidewall 11. Beverage glasses or beverage containers with varying diameters can also be supported by beverage support 6 by allowing the smaller diameter portion of the beverage glass or beverage container to sit below bottom surface 7 while the larger diameter of the beverage glass or beverage container rests on semicircular shelf 13. An example of this is the bowl of a typical wine glass resting on semicircular shelf 13 while the stem of the wine glass extends below the beverage support 6 and bottom surface 7.

Lateral channel 14 extends from semicircular opening 12 to periphery 3 and provides an opening from periphery 3 to semicircular opening 12 to allow for the passage of varying diameter beverage glasses and beverage containers as described in the preceding paragraph.

Specific embodiments and applications of the portable table have been disclosed. It should be apparent, however, to those skilled in the art that many more modifications besides those already described are possible without departing from the inventive concepts herein. The inventive subject matter, therefore, is not to be restricted except in the spirit of the appended claims. For example, the table can include a bottle opener on a sidewall, or it can include hooks or other openings to hold various items. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components or steps may be present, or utilized, or combined with other elements, components, or steps that are not expressly referenced.

DESIGN FEATURES

The present invention includes as an additional embodiment the ornamental design of the table as shown in FIGS. 1-9 of the drawings. In this regard, many of the specific details of the table are not necessary to define the design, For example, the attachment of the leg to the bottom of the table is not critical and the preferred design shown is only one way to do this. Instead, the leg can be attached directly to the table bottom.

The corners of the table are rounded but the exact arcuate nature of the rounding is also not critical. The same is true for any of the edges of the table or its openings: these can be curved or smoothed from the top or bottom to the sides or they can be perpendicular.

Finally, the bottle openers, hand hold, and clips for holding the leg are all optional features that do not detract from the overall design which can include one two three or four glass holders as desired.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention that is defined by the following claims. For example, notwithstanding the fact that the elements of the claims are set forth below in a certain combination, it must be expressly understood that the invention includes other combinations of fewer, more or different elements, which are disclosed herein even when not initially claimed in such combinations.

What is claimed is:

1. A portable table comprising:

a single, stationary plate having a periphery, a top surface, a center, a bottom surface, a sidewall, and a thickness;

at least two beverage supports provided in the plate, wherein each support includes a semicircular shelf that partially surrounds a circular opening that passes through the plate from the top surface to the bottom surface, with the opening in the plate being larger above the shelf, wherein the shelf is configured to support and hold a beverage glass or beverage container that is placed in the opening, a lateral channel extending through the thickness of the plate from each circular opening through the shelf and to the plate periphery, wherein the each channel is configured to allow a wine glass stem to pass from the plate periphery to the opening for placement of the wine glass on the support with the stem freely extending below the bottom surface of the table and with the shelf configured to separately support a beverage can or bottle in the opening; wherein the semi-circular shelf surrounds the circular opening of the beverage support except where the lateral channel passes through the shelf, has a thickness that is equal to 1/10 to 1/12 of the thickness of the plate, and has a bottom surface that is flush with the bottom surface of the plate;

a single leg mounted centrally beneath the center of the plate for supporting and positioning the plate upright so that the plate top surface is available as a top surface of the table;

wherein the beverage supports are arranged in the plate by being spaced equidistantly from the center of the plate but in opposite directions to facilitate balancing of the table when containers or glasses are placed in the support;

wherein the plate further comprises an elongated opening that serves as a handhold for grasping and transport of the table with the opening located near the periphery of the plate above its center of gravity.

2. The table of claim 1, wherein the leg is removably associated with the plate, and the table further comprises at least one fastening device associated with the bottom surface of the plate for receiving and attaching the leg to the table through an attachment point.

3. The table of claim 2, wherein the attachment point includes threads and the leg has a body with a threaded end that attaches to the attachment point by engaging the threads of the attachment point.

4. The table of claim 2, wherein the plate further comprises clip members on the lower surface for securing the leg to the table for transport when the leg is not attached to the fastening device at the attachment point.

5. The table of claim 2 wherein the leg has a lower end that has a smaller diameter than the body of the leg to facilitate insertion of the leg into sand or soft ground.

6. The table of claim 1 further comprising at least one loop located on the periphery of the table.

7. The table of claim 6 which is constructed of wood, metal, plastic or a composite material and at least two loops are spaced along the periphery of the table.

8. The table of claim 1 wherein the upper surface and periphery of the plate are smooth to the touch and optionally includes a chamfer between the plate upper surface and periphery.

9. A portable table comprising:

a single, stationary plate having a periphery, a top surface, a center, a bottom surface, a sidewall, and a thickness;

at least two beverage supports provided in the plate, wherein each support includes a semicircular shelf that partially surrounds a circular opening that passes through the plate from the top surface to the bottom surface, with the opening in the plate being larger above the shelf, wherein the shelf is configured to support and hold a beverage glass or beverage container that is placed in the opening, a lateral channel extending through the thickness of the plate from each circular opening through the shelf and to the plate periphery, wherein the each channel is configured to allow a wine glass stem to pass from the plate periphery to the opening for placement of the wine glass on the support with the stem freely extending below the bottom surface of the table and with the shelf configured to separately support a beverage can or bottle in the opening; wherein the semi-circular shelf surrounds the circular opening of the beverage support except where the lateral channel passes through the shelf, has a thickness that is equal to 1/10 to 1/12 of the thickness of the plate, and has a bottom surface that is flush with the bottom surface of the plate;

a single leg mounted centrally beneath the center of the plate for supporting and positioning the plate upright so that the plate top surface is available as a top surface of the table;

wherein the beverage supports are arranged in the plate by being spaced equidistantly from the center of the plate but in opposite directions to facilitate balancing of the table when containers or glasses are placed in the support;

at least one indentation in the plate and extending to the bottom surface of the plate with the indentation including a bottle opener device therein.

10. A portable table comprising:

a single, stationary plate having a periphery, a top surface, a center, a bottom surface, a sidewall, and a thickness;

at least two beverage supports provided in the plate, wherein each support includes a semicircular shelf that partially surrounds a circular opening that passes through the plate from the top surface to the bottom surface, with the opening in the plate being larger above the shelf, wherein the shelf: has a thickness that is equal to 1/4 to 2/5 of the thickness of the plate, and has a bottom surface that is flush with the bottom surface of the plate, with the shelf configured to support and hold a beverage glass or beverage container that is placed in the opening and wherein the beverage supports are arranged in the plate by being spaced equidistantly from the center of the plate but in opposite directions to facilitate balancing of the table when containers or glasses are placed in the support;

a lateral channel extending through the thickness of the plate from the circular opening through the shelf and to the plate periphery, wherein the channel is configured to allow a wine glass stem to pass from the plate periphery to the opening for placement of the wine glass on the support with the stem freely extending below the bottom surface of the table and with the shelf configured to separately support a beverage can or bottle in the opening;

an elongated opening that serves as a handhold for grasping and transport of the table with the opening located near the periphery of the plate above its center of gravity;

a single leg mounted centrally beneath the center of the plate for supporting and positioning the plate upright so that the plate top surface is available as a top surface of the table; wherein the leg is removably associated with the plate;

at least one fastening device associated with the bottom surface of the plate at the center for receiving and attaching the leg to the table through an attachment point;

clip members on the lower surface for securing the leg to the table for transport when the leg is not attached to the fastening device at the attachment point; and wherein the semicircular shelf surrounds the circular opening of the beverage support except where the lateral channel passes through the shelf.

11. The table of claim 10 further comprising at least one loop located on the periphery of the table.

12. The table of claim 11, which is constructed of wood, metal, plastic or a composite material and at least two loops are spaced along the periphery of the table.

13. The table of claim 12 further comprising at least one indentation in the plate and extending to the bottom surface of the plate with the indentation including a bottle opener device therein.

14. The table of claim 13, wherein the upper surface and periphery of the plate are smooth to the touch and optionally includes a chamfer between the plate upper surface and periphery.

* * * * *

UNITED STATES PATENT AND TRADEMARK OFFICE

CERTIFICATE OF CORRECTION

PATENT NO. : 9,220,337 B1
APPLICATION NO. : 14/725761
DATED : December 29, 2015
INVENTOR(S) : Wenzel It is certified that error appears in the above-identified patent and that said Letters Patent is hereby corrected as shown below:

IN THE CLAIMS

Column 6:
Line 41 (claim 1, line 23), delete "1/12" and insert -- 1/2 --.

Column 7:
Line 37 (claim 9, line 23), delete "1/12" and insert -- 1/2 --.

Signed and Sealed this
First Day of March, 2016

Michelle K. Lee

Michelle K. Lee
*Director of the United States Patent and Trademark Office*